US006880792B2

(12) United States Patent
Muir

(10) Patent No.: US 6,880,792 B2
(45) Date of Patent: Apr. 19, 2005

(54) DETACHABLE ARM LIMITING ASSEMBLY

(75) Inventor: Malcolm Muir, Honeoye Falls, NY (US)

(73) Assignee: Advantage Manufacturing Corp., Victor, NY (US)

( * ) Notice: Subject to any disclaimer, the term of this patent is extended or adjusted under 35 U.S.C. 154(b) by 101 days.

(21) Appl. No.: 10/011,326

(22) Filed: Oct. 22, 2001

(65) Prior Publication Data

US 2003/0075656 A1 Apr. 24, 2003

(51) Int. Cl.[7] ..... E04G 3/00

(52) U.S. Cl. ..... 248/276.1; 248/287.1; 49/339

(58) Field of Search ..... 248/276.1, 286.1, 248/244, 287.1, 285.1, 274.1, 281.1, 279.1; 49/337, 346, 246; 16/339, 337, 363, 364, 371

(56) References Cited

U.S. PATENT DOCUMENTS

| | | | | | |
|---|---|---|---|---|---|
| 1,753,264 | A | * | 4/1930 | Davis | 16/361 |
| 1,787,917 | A | * | 1/1931 | Potter | 16/361 |
| 1,986,532 | A | * | 1/1935 | Roethel | 268/126 |
| 3,722,142 | A | * | 3/1973 | Anderberg et al. | 49/248 |
| 4,382,312 | A | * | 5/1983 | Liggett et al. | 16/288 |
| 4,726,092 | A | * | 2/1988 | Tacheny et al. | 16/342 |
| 4,768,824 | A | * | 9/1988 | Andonian | 296/165 |
| 4,833,754 | A | * | 5/1989 | Yang | 16/337 |
| 4,986,028 | A | * | 1/1991 | Schneider et al. | 16/361 |
| 5,392,494 | A | * | 2/1995 | Wronski | 16/270 |
| 5,898,977 | A | * | 5/1999 | Muir | 16/341 |
| 6,138,325 | A | * | 10/2000 | Figliola et al. | 16/363 |
| 6,402,109 | B1 | * | 6/2002 | Dittmer | 248/279.1 |
| 2002/0078528 | A1 | * | 6/2002 | Gledhill | 16/362 |

FOREIGN PATENT DOCUMENTS

| | | | | |
|---|---|---|---|---|
| GB | 2209051 | * | 4/1989 | E05D/15/44 |

* cited by examiner

*Primary Examiner*—Leslie A. Braun
*Assistant Examiner*—A. Joseph Wujciak
(74) *Attorney, Agent, or Firm*—Brian B. Shaw, Esq.; Stephen B. Salai, Esq.; Harter, Secrest & Emery LLP

(57) ABSTRACT

A mechanism which selectably limits the opening of a hinged window vent. The mechanism has a releasable arm that permits the vent to be conveniently opened beyond the selected limit. An assembly is disclosed for limiting travel of a vent relative to a frame. The assembly includes a security fastener for restricting transition of the assembly between a locked configuration and an unlocked configuration. An arm is pivotally connected to a mounting bracket by a locking plate and a loading pin.

12 Claims, 7 Drawing Sheets

Fig. 2
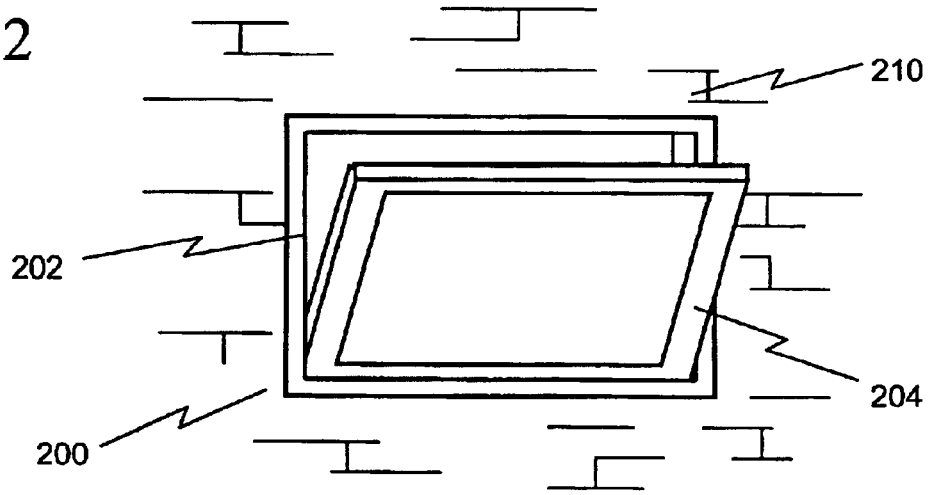
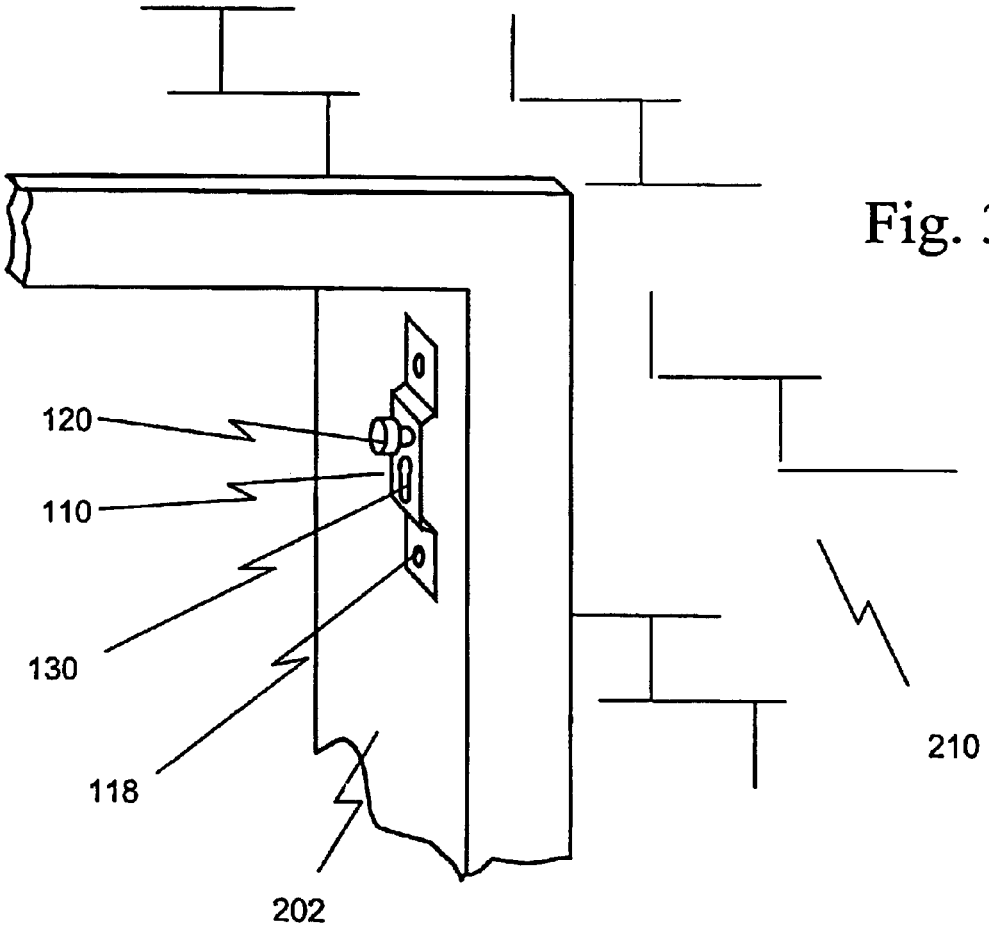
Fig. 3

Fig. 6
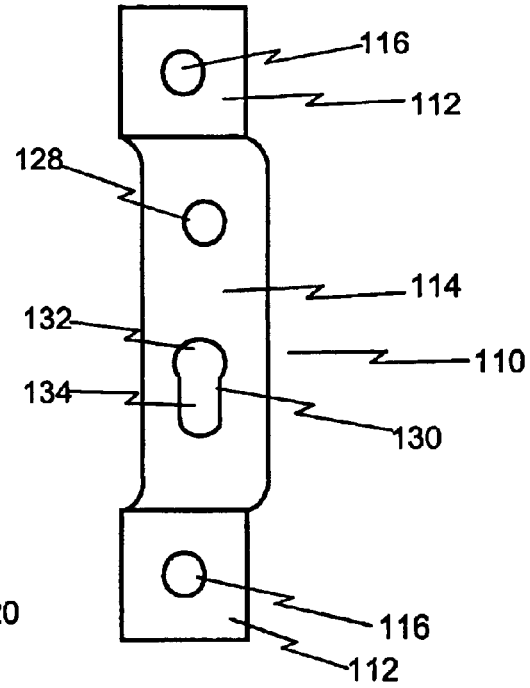
Fig. 7
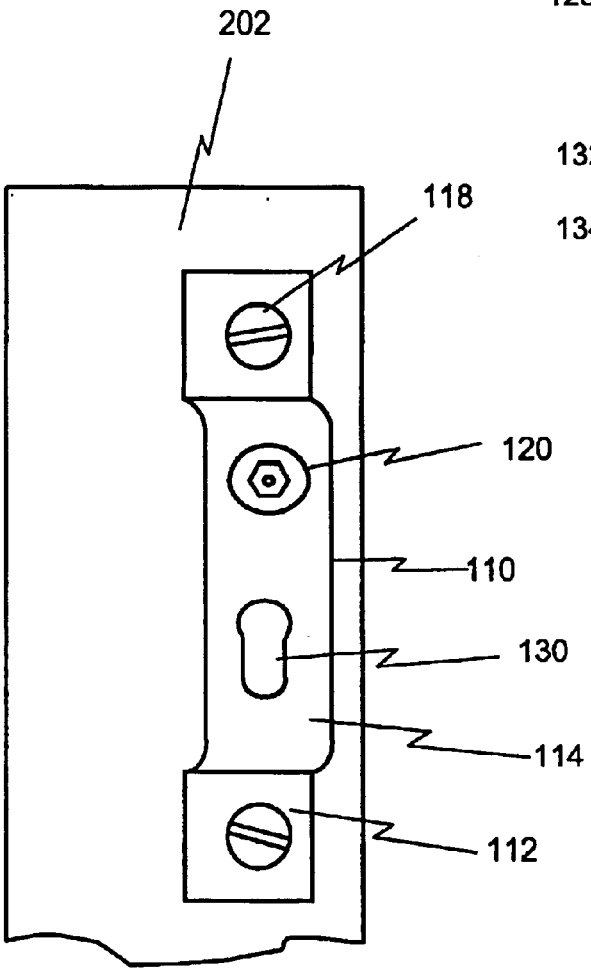
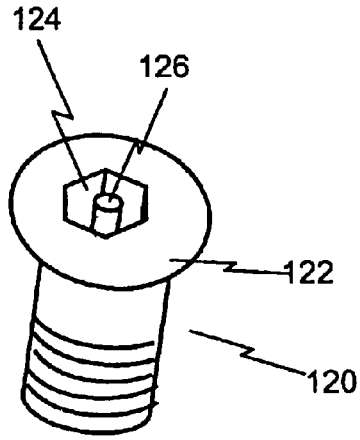
Fig. 8

Fig. 9
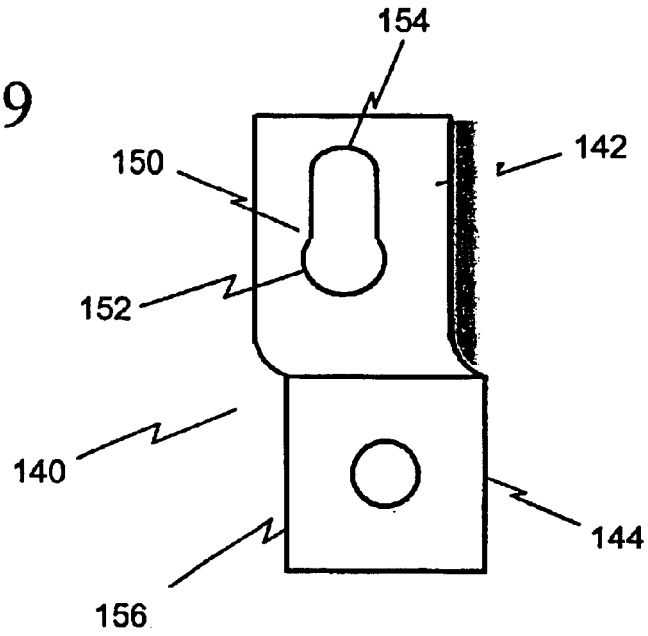
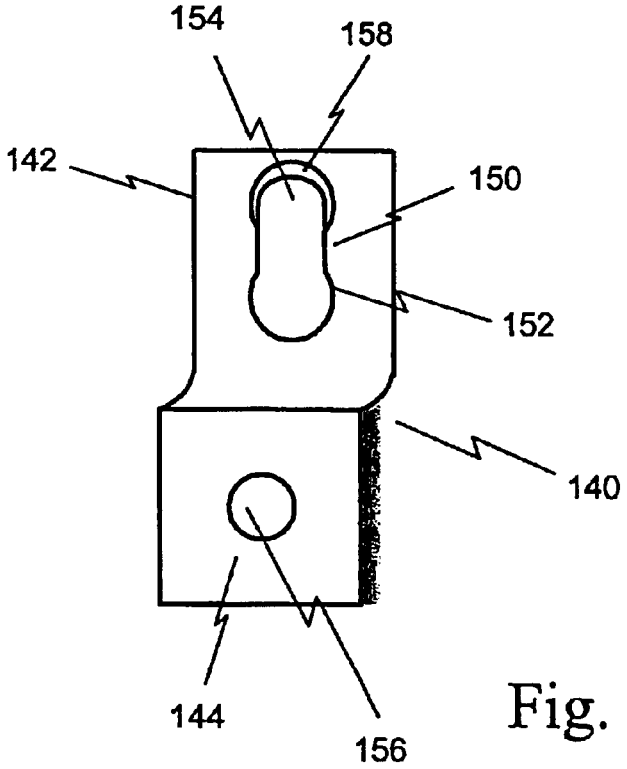
Fig. 10

Fig. 11
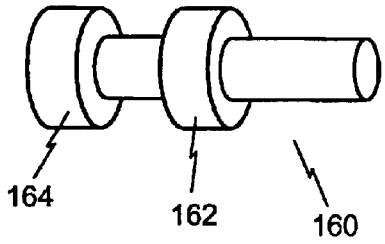
Fig. 12
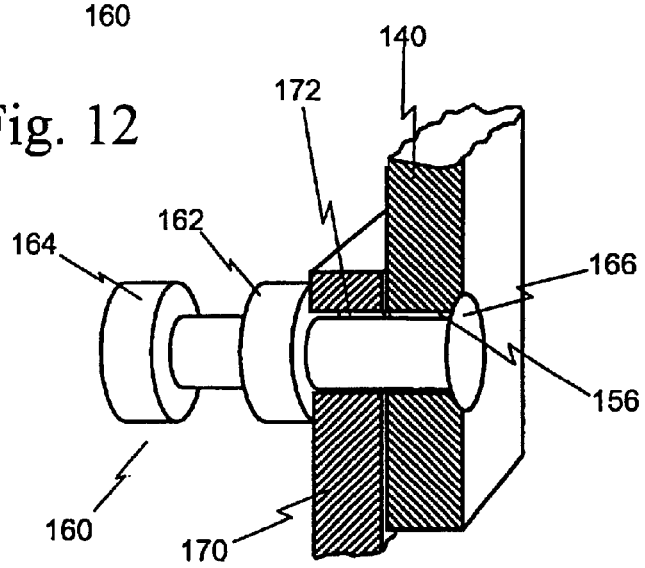
Fig. 13
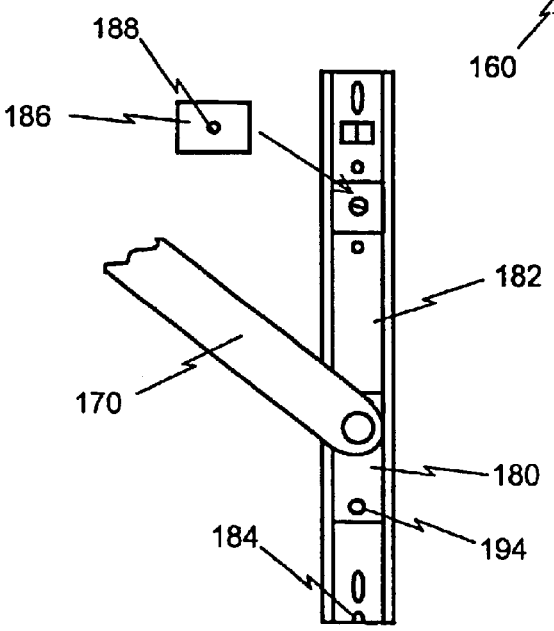
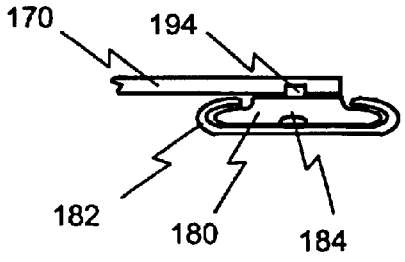
Fig. 14

Fig. 15
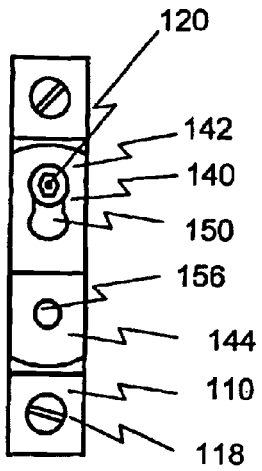
Fig 16
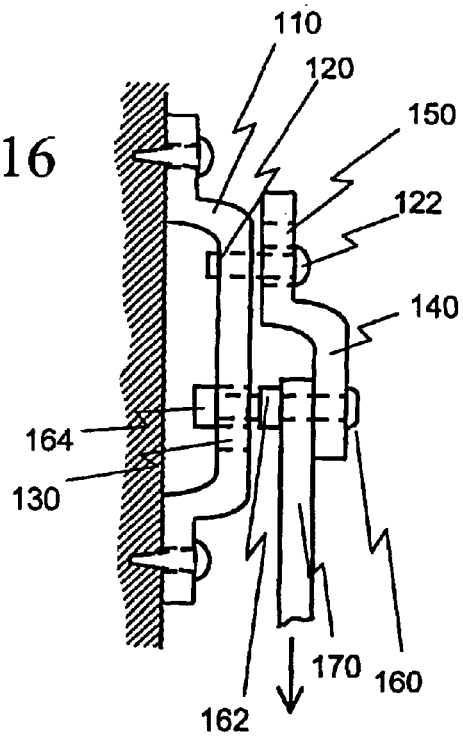
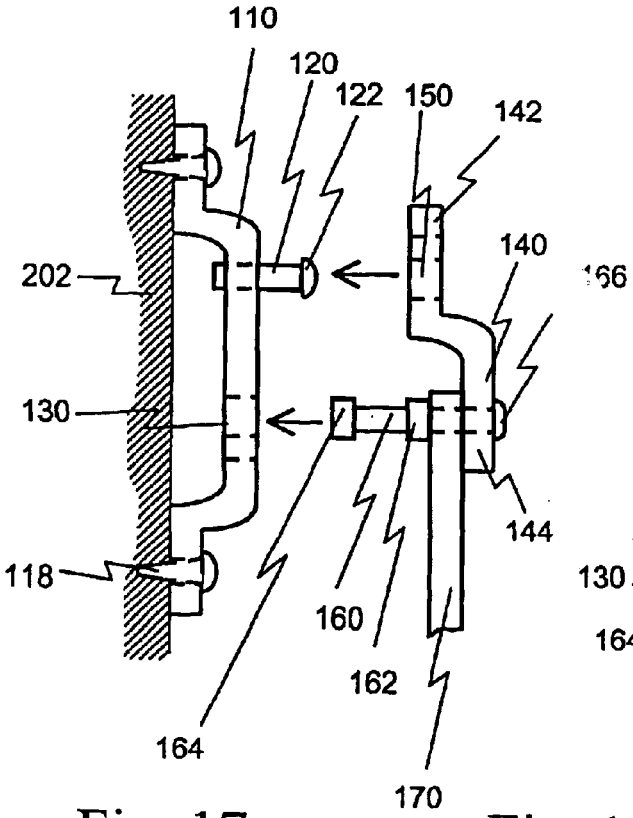
Fig. 17
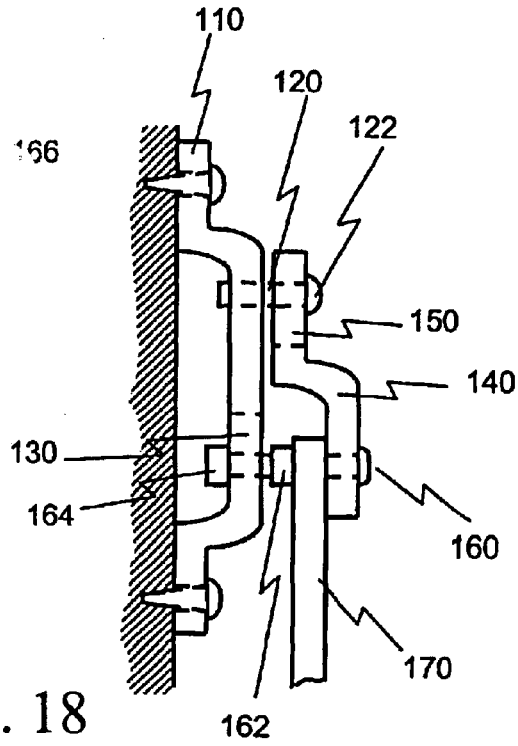
Fig. 18

DETACHABLE ARM LIMITING ASSEMBLY

FIELD OF THE INVENTION

This invention relates to a mechanism for limiting the travel of a hinged window in a frame, and in particular to an assembly that is releasably and securely fastened to the window and the frame.

BACKGROUND OF THE INVENTION

A common type of window includes a rectangular frame set into a building wall and a corresponding vent connected to the frame by a hinge assembly. The hinge assembly can be oriented so that the vent can pivot about either a horizontal or a vertical axis. Thus, the vent can be opened by pivoting inward and downward about a horizontal axis. Various means are available for securing the vent at a selectable angle to make the opening larger or smaller. It is often desirable to limit the size of the opening; for example, the window might be located in a school, where it is clearly preferable that the opening not be large enough to permit unauthorized, unintended or accidental entry or exit. Prior hinge assemblies include limit mechanisms, to preclude the vent being opened wider than a desired limit.

However, it is also desirable that the vent occasionally be opened wider than the selected limit to permit the window to be cleaned or otherwise maintained from inside the building. Traditionally, the opening of the vent beyond the limited range required dismantling the hinge assembly in both the disassembly and reassembly of the hinge, which can involve an excessive amount of time and labor.

Therefore, a need exists to provide a mechanism, which normally limits the opening of the vent but also allows selective opening of the vent beyond a limited range. There is also a need to restrict the selective opening of the vent beyond the predetermined limit.

SUMMARY OF THE INVENTION

The present invention provides a detachable arm limiting assembly for setting a predetermined operating opening of the vent, and allowing selective maximum opening of the vent. Preferably, the detachable arm limiting assembly can be selectively actuated to permit a full range of motion for the vent.

The detachable arm limiting assembly includes a mounting bracket secured to a window frame, a slide assembly secured to a vent and an arm pivotally connected to the slide assembly. The arm is a pivotally attached to a locking plate, which is removably attachable to the mounting bracket. One of the locking plate and the arm includes a loading pin. The mounting bracket has a keyway sized to receive the loading pin. The locking plate has a keyway for receiving a fastening interconnecting the locking plate and the mounting bracket. When the locking plate is in a first position, the keyways can accept the corresponding loading pin and fastener. The keyways are configured to then allow the locking plate to be moved to a second engaged position relative to the mounting plate. The fastener can be actuated, thus securing together the locking plate and the mounting bracket. The slide assembly has an adjustable stop to limit the travel of the arm relative to the vent.

When the locking plate is secured to the mounting bracket, the degree to which the vent can be opened is limited. However, all that is required to allow the vent to be fully opened for cleaning or other maintenance is the loosening of the fastener, which allows the locking plate and the mounting plate to be moved from the second engaged position, to the first position, thus allowing ready disengagement of the arm from the mounting bracket. The present assembly has the advantage that while it is normally impractical to open of the vent beyond a selected limit, upon releasing the fastener the vent can quickly and easily be opened beyond this limit by a person having the appropriate tool for loosening the fastener.

BRIEF DESCRIPTION OF THE DRAWINGS

FIG. 2 is a perspective view of the window set in a building wall.

FIG. 3 is a perspective view showing the bracket affixed to a window frame.

FIG. 6 is a perspective view of the bracket.

FIG. 7 is a perspective view of the bracket as attached to the window frame.

FIG. 8 is a perspective view of a fastener, which engages the bracket.

FIGS. 9 and 10 are perspective views of the locking plate observed from opposed directions.

FIG. 11 is a perspective view of a loading pin of the assembly.

FIG. 12 shows partial cross-sections of the arm and the locking bracket and the engagement of the loading pin therewith.

FIG. 13 is a front view showing the engagement of the arm and a slide.

FIG. 14 is an end view showing the engagement of the arm and slide.

FIG. 15 is a front view showing the engagement of the locking plate and the bracket.

FIGS. 16, 17 and 18 are side views showing successive steps in the engagement of elements of the assembly.

DETAILED DESCRIPTION OF THE INVENTION

Figure 1:
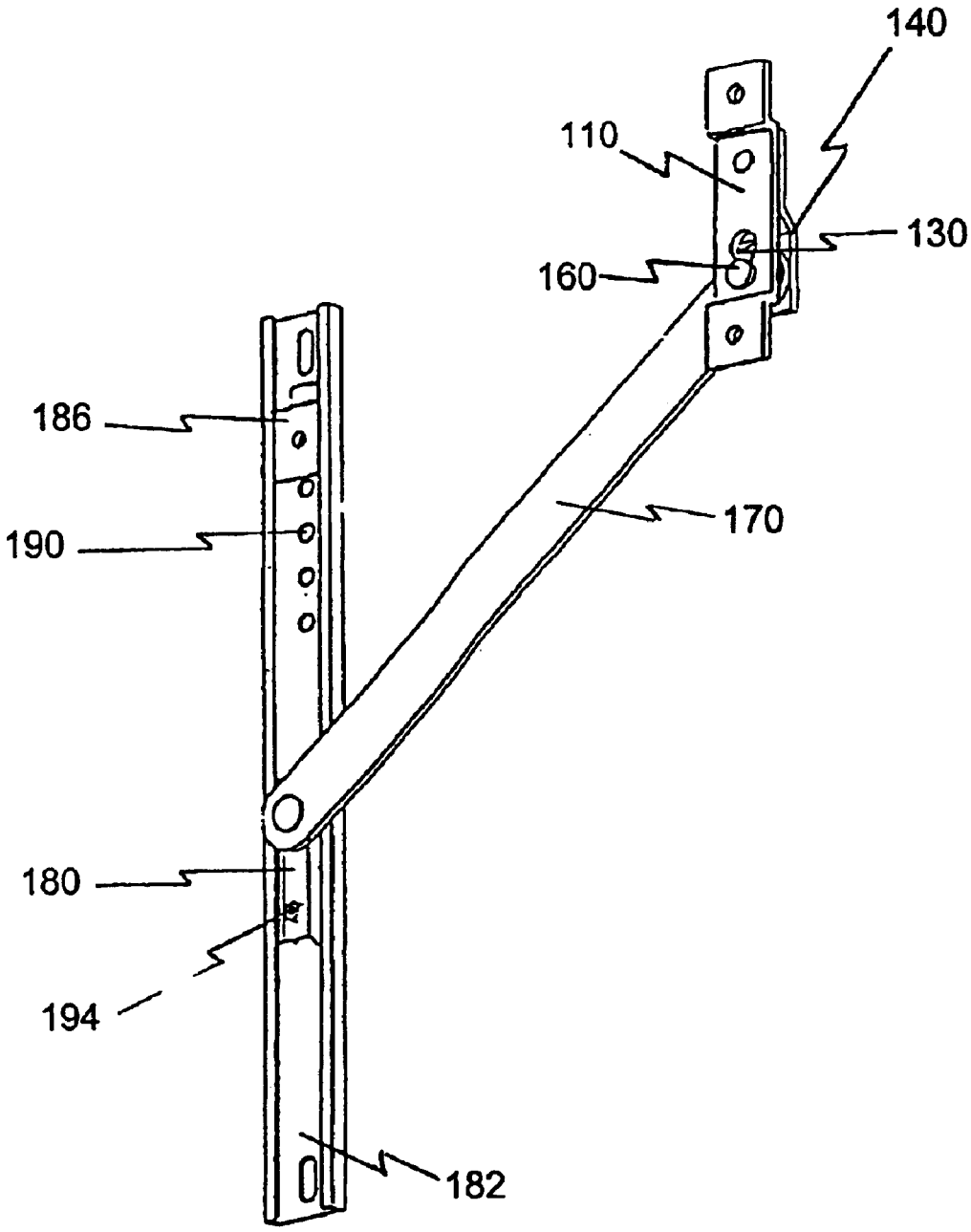
FIG. 1 is a general perspective view of a detachable arm assembly, having a mounting bracket, a locking plate and an arm for limiting the opening of a window.

Referring now to the drawings, FIGS. 1 and 2 show a preferred embodiment of a detachable arm limiting assembly 100, which is used to limit the opening of a window 200. The window moves relative to a frame 202 which is normally set into a building wall 210. The window is connected to a vent 204. The assembly 100 restricts the travel of the vent 204 relative to the frame 202. The vent 204 is typically rectangular in shape and engages the frame 202 through a conventional hinge mechanism such as a 4 bar hinge 206. The hinge 206 provides that the vent 204 can pivot about a horizontal axis. As indicated in FIG. 2, the vent is disposed so that it opens downward into the building. However, it is understood the axis about which the vent rotates can be horizontal, vertical or an intermediate orientation.

Figure 4:
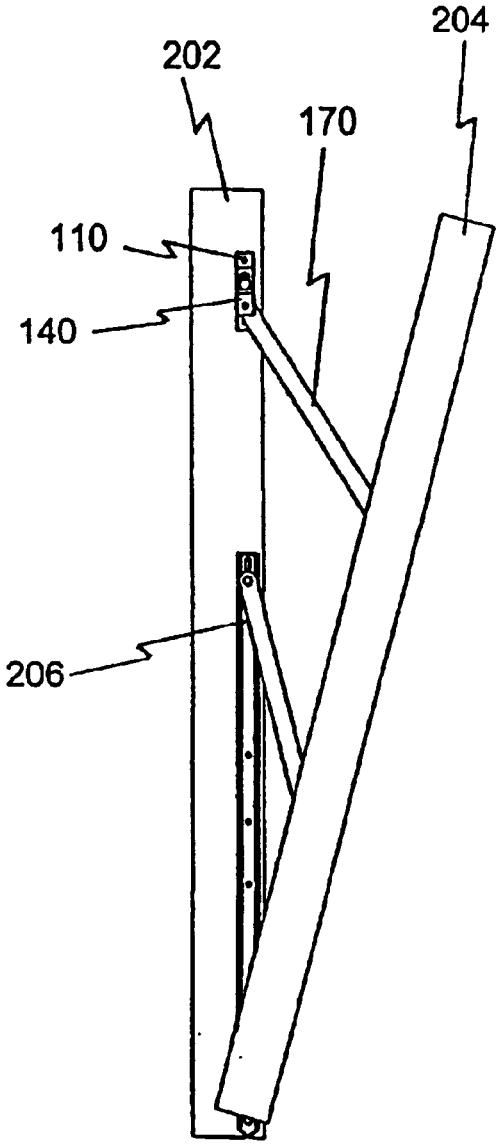
FIGS. 4 and 5 show side views of the assembly as attached to the window frame and to a window vent, respectively.
Figure 5:
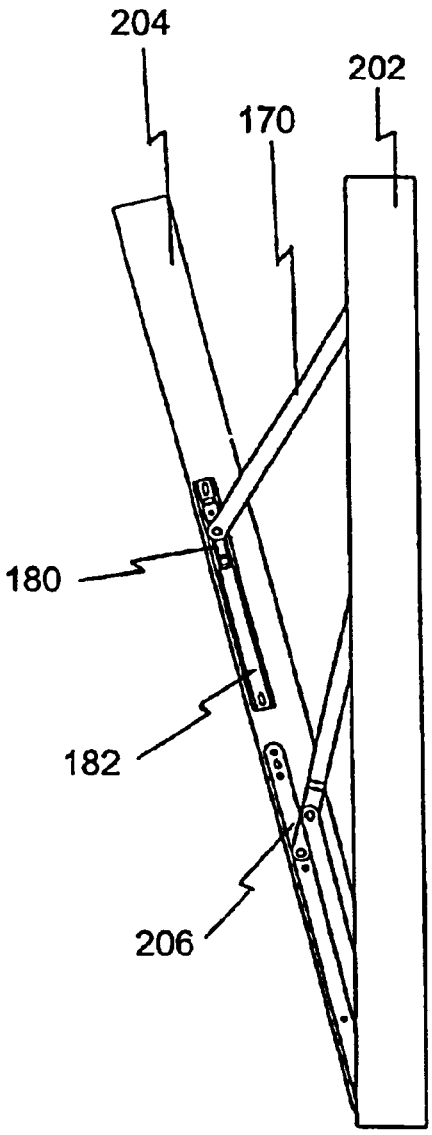

FIGS. 4 and 5 show the general disposition of the assembly 100 with the frame 202 and vent 204. FIG. 4 shows the attachment of the assembly 100 and the hinge mechanism 206 to the frame 202, while FIG. 5 shows the attachment to the vent 204.

The assembly 100 includes a mounting bracket 110, a locking plate 140 and an arm 170. The mounting bracket 110 has fastening portions such as ends 112 and a coupling portion such as mid-portion 114. Though not required, the coupling portion is disposed in a plane spaced from the fastening portion. As seen in FIG. 5, each end portion 112 has an attachment hole 116, which can accept an attachment means 118 for securing the mounting bracket to the frame 202. The attachment means 118 is typically a threaded fastener such as a screw or a bolt or rivet. The mid-portion 114 has a threaded aperture 128 and a first keyway 130. The threaded aperture 128 accepts a fastener which is typically a screw 120 with a screw head 122 configured to receive a corresponding tool for adjusting its position. Preferably, the screw 120 is a security type fastener capable of being driven by only a select driver configuration.

A preferred configuration of the screw head 122 is shown in FIG. 7. The head 122 has a hexagonal hole 124 with a central pin 126, which precludes the screw from being adjusted with a conventional Allen wrench, regular or Phillips screw driver. A less conventional hexagonal tool is required, which corresponds with the hexagonal hole but has an opening to accept the pin 126. Such a tool is unlikely to be carried by an unauthorized person. Therefore, as will be understood later, an unauthorized person would be most unlikely to be able to enter or exit the window 200 either by accident or intentionally.

Although the screw 120 can be removably attached to the threaded aperture 128, for convenience the screw is preferably swaged to be permanently attached to the mounting bracket 110, while retaining a desired degree of adjustability between a release position and a locking position.

In the normal vertical orientation of the mounting bracket 110 on the frame 202, the keyway 130 is below the threaded aperture 128. As evident from FIGS. 5 and 6, the mounting bracket 110 is configured so that when the mounting bracket is attached to the frame 202, a space remains between the mid-portion 114 and the frame 202. The keyway 130 has a bulbous section 132 and slot section 134 extending downward from the bulbous section 132.

The locking plate 140 (FIGS. 8 and 9) is generally step-shaped, having a frame-proximate portion 142 and a vent-proximate portion 144. In the intended, generally vertical, orientation of the locking plate 140, the frame-proximate portion 142 is uppermost and has a second keyway 150. The vent-proximate portion 144 has an aperture 156 for a loading pin 160. The second keyway 150 has a bulbous section 152 and a narrower slot section 154 extending upward from the wide portion 152. Bounding the slot section 154 is a generally circular recess or shoulder 158 sized to approximately the same diameter as the screw head. The recess 158 is on the side of the frame-proximate portion 142 intended to face the vent 204.

The loading pin 160 (FIG. 10) has a center flange 162 and an end flange 164 spaced therefrom. As seen in FIG. 11, to secure together the arm 170 and the locking plate 140, the pin 160 first through an aperture 172 near one end of the arm 170 and then through the aperture 156 of the locking plate 140, until the center flange 162 comes up against the arm 170. The formation of a swaged end 166 on the loading pin 160 permanently secures the locking plate 140 and the arm 170 in a pivotal relationship.

The opposed end of the arm 170 is pivotally and permanently connected to a generally rectangular shoe 180, which slidably engages an elongate track 182 as show in FIGS. 13 and 14. The shoe 180 can travel along the track 182 between limits defined by a permanent stop 184 and an adjustable stop 186. The same surface of the arm 170 faces both the shoe 180 and the locking plate 140. The adjustable stop 186 can be a metal plate with a hole 188. Prior to installation of the assembly 100, the stop 186 is free to slide along the track 182. Once the assembly is installed, the stop 186 can be located in a preferred position as will be shown later. A limit screw 194 is provided in the slide shoe 180. Limiting the angle through which the arm 170 can pivot when disengaged from the bracket 110, assists in precluding the vent 204 from opening too far and stressing the hinge 206.

The mounting bracket 110 and the locking plate 140, are configured so that the screw 120 and the bulbous section 132 of the first keyway 130 are spaced apart by the same distance as the loading pin 160 and the bulbous section 152 of the second keyway 150. The first keyway 130 can now engage the loading pin 160, and the second keyway 150 can engage the fastener 120, since the corresponding bulbous sections 132 and 152 are sized respectively to allow passage of the loading pin end flange 164 and of the screw head 122. Once such passage has occurred, the locking plate 140 is in a first or release position. It can be translated relative to the mounting bracket 110 to a second or locked position, wherein the loading pin 160 and the screw 120 are in alignment with the slots 134 and 154 of the corresponding keyways 130 and 150. FIG. 15 shows the locking plate in the locked position, other elements of the assembly 100 being omitted for clarity.

The mounting bracket 110, the locking plate 140 and the arm 170 are typically fabricated from a metal such as stainless steel about 0.1" (2.5 mm) thick. The track is composed of similar material with a thickness of about 0.06" (1.5 mm). The slide shoe 180 is typically a composite of a sheet metal pressed to conform to the profile of the track and a plastic contact member of high lubricity such as Teflon.

When the assembly 100 is installed in its intended position as illustrated in FIGS. 4 and 5, the bracket 110 is affixed vertically to the frame 202, using suitable fasteners such as screws. The track 182 is correspondingly screwed or otherwise mounted to the vent 204. Once the track 182 is attached to the vent 204, the hole 188 can be selectably aligned with one of a plurality of corresponding holes 190 in the track and secured in this position with a fastener which passes through the holes 188 and 190 and into the frame 202. The position of the adjustable stop 186 defines the uppermost limit of travel of the slide shoe 180 in the track.

Upon operable installation of the assembly 100, and that the locking plate 140 and bracket 110 the assembly disengaged, it is used according to steps illustrated in FIGS. 16, 17 and 18, as follows. The vent 204 is disposed at a suitable angle relative to the frame 202 and the slide shoe 180 positioned along the track 182 so that a user can align the wide portion 152 of the second keyway 150 with the screw head 122, the screw 120 being in the release position. At this point, if the locking plate 140 is not closely aligned with the orientation of the mounting bracket 110, the locking plate 140 is pivoted about the loading pin 160 until it is correctly aligned. Preferably, the locking plate 140 can be pivoted by hand, without freely pivoting under gravity alone.

The locking plate 140 being correctly aligned with the bracket 110, the user engages the locking plate 140 and the screw 120. As indicated previously, the wide portion 132 of the second keyway 150 accepts the screw head 122 and the wide portion 132 of the first keyway 130 accepts the end flange 164 of the loading pin 160. Once the screw head 122 and the end flange 164 have cleared the locking plate 140 and the bracket 110 respectively, the locking plate 140 is in the release position and is then translated downward into the interlock position. The screw 120 is then adjusted to the closed position, the screw head 122 being tightened into the recess 158 to secure the locking plate 140 to the bracket 110.

At this point, the arm 170 is still free to pivot about the loading pin 160 and also relative to the slide shoe 180. Thus, the vent 204 can be closed into the frame 202, or opened to a limit predetermined by setting of the adjustable stop 186. While the fastener secures the locking plate 140 against the bracket 110, the load exerted by the vent 204 when open is borne primarily by the loading pin 160 which in turn exerts the load downward onto the mounting bracket 110.

To permit cleaning or other maintenance work on the vent 204, the screw 120 is loosened and the locking plate 140 separated from the mounting bracket 110 by reversing the above-described procedure. Otherwise, as long as the locking plate 140 remains secured to the mounting bracket 110, the window 200 cannot now be opened beyond the predetermined limit. Since any person not having the proper tool would be unable to loosen the screw 120, accidental or unauthorized exit or entry through the window would be largely precluded. This is particularly important in a setting such as a school, where primary and elementary students might otherwise be especially vulnerable to accidents.

The interconnect or limiting assembly of this invention finds most practical use with a bottom-pivoted window vent that opens into the building, since it is desirable that work such as cleaning be done from inside the building. However, it could equally well be used if the vent opened outward. Furthermore, if the orientations of both keyways 130 and 150 were reversed, the invention could be used with a top-pivoted window vent.

While the invention has been described in connection with a preferred embodiment, nevertheless numerous and extensive departures may be made therein without however departing from the spirit of the invention and the scope of the appended claims.

What is claimed is:

1. An interconnect assembly for limiting the movement of an arm extending between a window and a frame, comprising:

(a) a mounting bracket having a first keyway;

(b) a locking plate pivotally coupled directly to the arm;

(c) a fastener for releasably engaging the locking plate and the mounting bracket; and (d) a loading pin configured to releasably locate the arm and the mounting bracket in a pivoting relation, the loading pin sized to releasably engage the first keyway.

2. The interconnect assembly of claim 1, wherein the locking plate includes a second keyway sized to engage the fastener.

3. The interconnect assembly of claim 1, further comprising a track and a shoe slidably engaged with the track, wherein the arm is pivotally connected to the shoe.

4. The interconnect assembly of claim 3, having an adjustable stop to limit translation of the shoe in the track.

5. The interconnect assembly of claim 3, having a pivot-limiting member being attached to the shoe.

6. The interconnect assembly of claim 1, wherein the loading pin pivotally connects the arm and the locking plate.

7. A detachable arm limiting assembly for a frame and a hingedly attached vent, the assembly comprising:

(a) a mounting bracket attachable to the frame, the bracket having a first keyway and a threaded hole spaced from the first keyway;

(b) a fastener engaging the threaded hole between a captive position and a release position;

(c) a locking plate having a second keyway sized to removably engage the fastener and a loading pin spaced from the second keyway, the loading pin sized to releasably engage the first keyway;

(d) an arm pivotally attached to the loading pin;

(e) a shoe pivotally attached to the arm; and (f) a track sized to slidably receive the shoe, the locking plate movable relative to the mounting bracket between a release position and an interlock position.

8. The assembly of claim 7, further comprising an adjustable stop connected to the track to limit translation of the shoe relative to the track.

9. The assembly of claim 7, further comprising a pivot-limiting member attached to the shoe.

10. A method for limiting the movement of an arm extending between a window frame and a window vent hingedly attached to the window frame, comprising:

(a) providing a mounting bracket, a fastener engaging the mounting bracket, a locking plate, and a loading pin;

(b) pivotally attaching the locking plate to the arm;

(c) attaching the bracket to the window frame;

(d) coupling the arm and the mounting bracket by locating the loading pin in a keyway in the mounting bracket; and (e) securing the locking plate to the bracket with the fastener.

11. The method of claim 10, further comprising attaching a track to the vent, providing a shoe engaging the track and pivotally attached to the arm, and providing slidably an adjustable stop limiting the a translation of the shoe relative to the track.

12. The method of claim 11, further comprising adjusting the stop to correspond to an opening of the vent.

* * * * *